United States Patent [19]

Neuhäuser et al.

[11] Patent Number: 4,597,939

[45] Date of Patent: Jul. 1, 1986

[54] SPRAY POWDER FOR PRODUCING WEAR RESISTANT COATINGS

[75] Inventors: Hans J. Neuhäuser, Bergisch Gladbach; Ulrich Buran, Burscheid; Manfred Fischer, Leichlingen; Horst Beyer, Burscheid, all of Fed. Rep. of Germany

[73] Assignee: Goetze AG, Burscheid, Fed. Rep. of Germany

[21] Appl. No.: 563,460

[22] Filed: Dec. 20, 1983

[30] Foreign Application Priority Data

Dec. 20, 1982 [DE] Fed. Rep. of Germany ..... 3247054

[51] Int. Cl.[4] ..... C23C 7/00

[52] U.S. Cl. ..... 420/429; 75/240; 75/245; 420/580

[58] Field of Search ..... 75/240, 241, 242, 245, 75/249, 236, 238; 420/429, 580

[56] References Cited

U.S. PATENT DOCUMENTS 4,066,451 1/1978 Rudy ..... 75/240

FOREIGN PATENT DOCUMENTS 944975 4/1974 Canada ..... 75/236
39759 3/1983 Japan ..... 75/240

OTHER PUBLICATIONS

Kieffer et al., "Tungsten Carbide-Free Hard Metals", Powder Metallurgy Bulletin, vol. 4, No. 1 (1949), pp. 4–17.

Chemical Abstracts, vol. 84 (1976), No. 183844, pp. 234–235.

Chemical Abstracts, vol. 93 (1980), No. 78065, pp. 388–389.

*Primary Examiner*—John F. Terapane
*Assistant Examiner*—Anne Brookes
*Attorney, Agent, or Firm*—Spencer & Frank

[57] ABSTRACT

A spray powder for the production of wear resistant coatings on the bearing and friction faces of machine parts subjected to sliding friction, comprising 20 to 60 weight percent molybdenum, 25 to 50 weight percent molybdenum carbide and up to 30 weight percent of a low melting point alloy.

6 Claims, No Drawings

SPRAY POWDER FOR PRODUCING WEAR RESISTANT COATINGS

BACKGROUND OF THE INVENTION

The present invention relates to a spray powder for producing wear resistant coatings on the bearing and friction faces of machine parts subjected to sliding friction, such as, in particular, piston rings in high rpm Diesel engines, the friction faces of synchronizing discs, or the fire lands of the bottoms of pistons in internal-combustion engines, with such coatings being preferably applied in a plasma spray process.

In practice, wear resistance is increased by providing the bearing faces of machine parts which are subjected to sliding friction primarily with electrochemically applied hard chromium coatings, or with thermally sprayed-on protective coatings, preferably of metals or metal alloys. Molybdenum, in particular, has been found to be excellently suitable as a spray material for coating primarily the bearing faces of piston rings used in internal-combustion engines. The molybdenum is here applied either over the entire surface area, or coatings are applied in a so-called sprayed-over form, or grooves and recesses are worked into the bearing faces which are then filled with the spray material and these are called coatings in unilaterally or bilaterally chambered form.

Molybdenum spray coatings, most of all, have excellent resistance to burn traces, while their wear resistance is inferior to that of electrochemically applied hard chromium coatings. Additionally, molybdenum spray coatings are relatively brittle so that, particularly under extreme loads, there exists the danger of the coatings breaking out (delaminating), this being the case with chambered as well as with sprayed-over rings.

For that reason, it has been attempted, particularly in order to improve the wear resistance of such coatings, to alloy or mix other elements to the molybdenum, and additionally to add hard substances to the spray powders. For example, the spray powders disclosed in DE-AS 2,433,814 include molybdenum and 0.5 to 45% iron, cobalt, nickel, titanium, vanadium, chromium, aluminum, tungsten, tantallum, rhenium and/or zirconium as well as 0.8 to 10% silicon and, according to DE-OS 2,841,552, spray powders are provided in which 3 to 40% aluminum alloy are mixed to the molybdenum. Both spray powders may possibly additionally contain hard substances based on carbides, nitrides, oxides and/or intermetallic compounds. These measures resulted primarily in an improvement of the wear resistance of such sprayed layers, but this improvement of wear resistance costs such coatings part of their resistance to burn traces or results in the coatings becoming more brittle so that under extreme loads, there are even more breakouts in the coatings.

SUMMARY OF THE INVENTION

It is therefore an object of the present invention to provide spray powder compositions which can be used to apply wear resistant coatings by thermal spray processes, particularly to the bearing faces of machine parts subjected to sliding friction, with such coatings being applied in sprayed-over and in unilaterally or bilaterally chambered form and exhibiting simultaneously reduced brittleness and thus improved resistance to breakouts without there being a significant reduction in the resistance to burn traces.

Another object of the present invention is to provide such spray powders which are suitable in particular for coatings on piston rings used in high rpm Diesel engines.

Additional objects and advantages of the present invention will be set forth in part in the description which follows and in part will be obvious from the description or can be learned by practice of the invention. The objects and advantages are achieved by means of the compositions, instrumentalities and combinations particularly pointed out in the appended claims.

To achieve the foregoing objects and in accordance with its purpose, the present invention provides a spray powder for the production of wear resistant coatings on the bearing and friction faces of machine parts subjected to sliding friction, the spray powder comprising a mixture of 20 to 60 parts by weight molybdenum, 20 to 50 parts by weight of a molybdenum carbide, and up to 30 parts by weight of a low melting point alloy.

Preferably, the low melting point alloy is a chromium alloy, a chromium-nickel alloy and/or an aluminum alloy and their minimum content is more than 3 parts by weight.

The coatings produced from the spray powders of the present invention exhibit improved wear resistance and improved resistance to breakouts compared to pure molybdenum coatings, thus making possible the use of piston rings in which such coatings are sprayed over without the previously customary beveling of their edges and without the resistance to burn traces of such coatings being reduced compared to pure molybdenum coatings.

It is to be understood that both the foregoing general description and the following detailed description are exemplary and explanatory, but are not restrictive of the invention.

DETAILED DESCRIPTION OF THE INVENTION

The molybdenum carbide employed in the present invention preferably is a carbide of the composition $Mo_2C$. The preferably employed low melting point alloys are nickel-chromium alloys, containing 75 to 85% nickel and 15 to 25% chromium, or aluminum alloys containing 10 to 20% silicon and 80 to 90% aluminum.

The spray powder may be employed in the form of mixtures of the two or three components, but preferred are micropellets, or alloys, or compound powders of two or possibly all components. Preferably, the powders are applied in a plasma spray process.

Rings coated with the spray powders according to the present invention, produced in sprayed-over as well as unilaterally or bilaterally chambered form, were subjected to engine test runs in which it was found that, with a molybdenum content in the powder of less than 20 weight percent, the wear at the bearing face of the counterpartner in the cylinder liner becomes too great. With molybdenum contents in the powder of more than 60 weight percent, however, the wear resistance of the spray coating is no longer sufficient. Conversely, with a molybdenum carbide proportion of less than 25 weight percent, the wear resistance of the coatings themselves is too low, while greater proportions of molybdenum carbide of more than 50 weight percent unduly increase wear of the friction partners.

However, it has also been surprisingly found that coatings of molybdenum containing molybdenum carbide within the stated quantity ratios have no influence whatsoever on the resistance of the coatings to burn traces. The coatings of molybdenum containing molybdenum carbide exhibited similar resistance to burn traces as do pure molbydenum coatings.

The addition of low melting point alloys on the basis of chromium-nickel alloys and/or aluminum alloys increases the toughness of the coatings so that the thus produced piston rings exhibit greater resistance to coating break-out. Thus, the bearing faces of piston rings that were experimentally coated with such powder coatings in sprayed-over form could be manufactured with almost sharp edges, i.e. their edges were not beveled as was customary in the past. Rather, by coating the bearing faces with such powder coatings, the edges extended almost at a right angle to the bearing face. In engine test runs, such rings generally did not incur any damage to their coatings in the edge regions.

Although the spray powders according to the present invention are preferably to be used for coatings on piston rings, they can also be used, within the scope of the present invention, for similar applications. It has been found that such powders are also suitable for coating fire lands and the bottoms of pistons in internal-combustion engines. The friction faces of synchronizing discs have also been coated with the powders according to the present invention.

The spray powder compositions of the present invention can comprise, consist essentially of, or consist of the two or three components described herein.

The following spray powder compositions have been found to be particularly advantageous for the production of coatings in the plasma spray process:

Spray Powder 1
- 45 weight percent molybdemum
- 45 weight percent molybdenum carbide
- 10 weight percent aluminum alloy containing
  - 12 weight percent silicon and remainder aluminum Spray Powder 2
- 40 weight percent molybdenum
- 40 weight percent molybdenum carbide
- 20 weight percent nickel-chromium alloy containing
  - 20 weight percent chromium and
  - 80 weight percent nickel Spray Powder 3
- 50 weight percent molybdenum
- 25 weight percent molybdenum carbide
- 25 weight percent of a nickel-chromium alloy containing
  - 20 weight percent chromium and
  - 80 weight percent nickel.

It will be understood that the above description of the present invention is susceptible to various modifications, changes and adaptations, and the same are intended to be comprehended within the meaning and range of equivalents of the appended claims.

What is claimed is:

1. Spray powder for the production of wear resistant coatings on the bearing and friction faces of machine parts subjected to sliding friction, the spray powder consisting essentially of the following components:
- 20 to 60 weight percent molybdenum,
- 20 to 50 weight percent molybdenum carbide and
- 3 to 30 weight percent of a low melting point alloy, wherein said low melting point alloy is at least one alloy selected from the group consisting of chromium alloys, chromium-nickel alloys, and aluminum alloys.

2. Spray powder as defined in claim 1, wherein the molybdenum carbide employed is a carbide of the composition $Mo_2C$.

3. Spray powder as defined in claim 1, wherein the low melting point alloy employed is a nickel-chromium alloy containing 75 to 85 weight percent nickel and 15 to 25 weight percent chromium.

4. Spray powder as defined in claim 1, wherein the low melting point alloy employed is an aluminum alloy comprising 10 to 20 weight percent silicon and the remainder aluminum.

5. Spray powder as defined in claim 1, wherein the spray powder is a mixture of particulates of molybdenum, particulates of molybdenum carbide and particulates of a low melting point alloy.

6. Spray powder as defined in claim 1, wherein the spray powder consists essentially of molybdenum, molybdenum carbide and low melting point alloys in at least one form selected from the group consisting of micropellets that consist of a single individual component in each micropellet, powders comprising alloys of at least two of said components in each powder particle, and compound powders comprising at least two of said components in each powder particle.

* * * * *